US008642946B2

(12) United States Patent
Splendore et al.

(10) Patent No.: US 8,642,946 B2
(45) Date of Patent: Feb. 4, 2014

(54) APPARATUS AND METHOD FOR A MULTI-STAGE ION TRANSFER TUBE ASSEMBLY FOR USE WITH MASS SPECTROMETRY

(71) Applicants: Maurizio Splendore, Walnut Creek, CA (US); Eloy R. Wouters, San Jose, CA (US); Rohan A. Thakur, Fremont, CA (US); Jean-Jacques Dunyach, San Jose, CA (US)

(72) Inventors: Maurizio Splendore, Walnut Creek, CA (US); Eloy R. Wouters, San Jose, CA (US); Rohan A. Thakur, Fremont, CA (US); Jean-Jacques Dunyach, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 13/656,595

(22) Filed: Oct. 19, 2012

(65) Prior Publication Data

US 2013/0043385 A1 Feb. 21, 2013

Related U.S. Application Data

(63) Continuation of application No. 11/601,282, filed on Nov. 17, 2006, now abandoned.

(51) Int. Cl.
*H01J 49/00* (2006.01)

(52) U.S. Cl.
USPC ..... 250/281; 250/282; 250/288; 250/289

(58) Field of Classification Search
USPC ..... 250/281, 288, 289
See application file for complete search history.

(56) References Cited

U.S. PATENT DOCUMENTS

| | | | | |
|---|---|---|---|---|
| 4,542,293 | A | 9/1985 | Fenn et al. | |
| 4,977,320 | A | 12/1990 | Chowdhury et al. | |
| 5,130,538 | A | 7/1992 | Fenn et al. | |
| 5,157,260 | A | 10/1992 | Mylchreest et al. | |
| 5,245,186 | A | 9/1993 | Chait et al. | |
| 5,481,107 | A * | 1/1996 | Takada et al. | 250/281 |
| RE35,413 | E | 12/1996 | Mylchreest et al. | |
| 5,750,993 | A | 5/1998 | Bier | |
| 5,818,041 | A | 10/1998 | Mordehai et al. | |
| 6,278,111 | B1 | 8/2001 | Sheehan et al. | |
| 6,646,258 | B2 * | 11/2003 | Russ, IV | 250/292 |
| 6,667,474 | B1 | 12/2003 | Abramson et al. | |
| 6,777,672 | B1 | 8/2004 | Park | |
| 6,803,565 | B2 * | 10/2004 | Smith et al. | 250/288 |
| 2005/0072916 | A1 | 4/2005 | Park | |
| 2005/0109948 | A1 | 5/2005 | Park et al. | |
| 2007/0205362 | A1 * | 9/2007 | Musselman | 250/288 |

* cited by examiner

*Primary Examiner* — Robert Kim
*Assistant Examiner* — Hanway Chang
(74) *Attorney, Agent, or Firm* — Charles B. Katz; Pamela Lau Kee; Freedman & Associates

(57) ABSTRACT

An apparatus and method for introducing ions into a vacuum chamber of a mass spectrometer includes producing ions in an ionization chamber of an ion source. The ions are sampled into an intermediate pressure chamber via a first ion transfer tube. In particular, the pressure within the intermediate pressure chamber is maintained at a value that exceeds a maximum pressure for being sampled into the vacuum chamber of the mass spectrometer. Some of the ions are sampled from the intermediate pressure chamber via at least a second ion transfer tube, the at least a second ion transfer tube having an outlet end that is in communication with a low-pressure chamber. In particular, the pressure within the low-pressure chamber is maintained at a value that is less than a maximum pressure for being sampled into the vacuum chamber of the mass spectrometer. Some of the ions are sampled from the low-pressure chamber into the vacuum chamber of the mass spectrometer.

11 Claims, 7 Drawing Sheets

APPARATUS AND METHOD FOR A MULTI-STAGE ION TRANSFER TUBE ASSEMBLY FOR USE WITH MASS SPECTROMETRY

CROSS-REFERENCE TO RELATED APPLICATIONS

This application is a continuation, under 35 U.S.C. §120 and claims the priority benefit of U.S. patent application Ser. No. 11/601,282, filed Nov. 17, 2006, entitled "Apparatus and Method for a Multi-Stage Ion Transfer Tube Assembly for Use with Mass Spectrometry". The disclosure of the foregoing application is incorporated herein by reference.

FIELD OF THE INVENTION

The instant invention relates generally to the field of mass spectrometry, and more particularly to a multi-stage ion transfer tube assembly for transferring ions from an ionization chamber of an ionization source to a lower pressure chamber of a mass spectrometer system.

BACKGROUND OF THE INVENTION

A number of atmospheric pressure ionization (API) sources have been developed for producing ions from a sample at atmospheric pressure. One well-known and important example is the electrospray ionization (ESI) source. The electrospray ionization technique, and more specifically electrospray ionization sources interfaced to mass spectrometers, has opened a new era of study for the molecular weight determination of labile and involatile biological compounds. In electrospray ionization, singly or multiply charged ions in the gas phase are produced from a solution at atmospheric pressure. The mass-to-charge (m/z) ratio of the ions that are produced by electrospray ionization depends on the molecular weight of the analyte and the solution chemistry conditions. Fenn et al. in U.S. Pat. No. 5,130,538 describes extensively the production of singly and multiply charged ions by electrospray ionization at atmospheric pressure.

Briefly, the electrospray process consists of flowing a sample liquid through a small tube or needle, which is maintained at a high voltage relative to a nearby surface. The voltage gradient at the tip of the needle causes the liquid to be dispersed into fine electrically charged droplets. Under appropriate conditions the electrospray resembles a symmetrical cone consisting of a very fine mist of droplets of ca. 1 μm in diameter. Excellent sensitivity and ion current stability is obtained if a fine mist is produced. Unfortunately, the electrospray "quality" is highly dependent on the bulk properties of the solution that is being analyzed, such as for instance surface tension and conductivity. The ionization mechanism involves desorption at atmospheric pressure of ions from the fine electrically charged particles. In many cases a heated gas is flowed to enhance desolvation of the electrosprayed droplets. The ions created by the electrospray process are then mass analyzed using a mass analyzer.

In electrospray ionization the ions are formed in an ionizing region, which is generally maintained at atmospheric pressure, and are drawn through an orifice or ion transfer tube into a low-pressure region where they undergo a free jet expansion. U.S. Pat. No. 4,542,293 describes the use of an ion transfer tube for conducting ions between the ionizing electrospray region at atmospheric pressure and a low-pressure region. A glass, metal or quartz capillary is suitable for this purpose. Ions and gas are caused to flow from the ionization region through the ion transfer tube into the low-pressure region where the free jet expansion occurs. A conducting skimmer is disposed adjacent the end of the tube and is maintained in a field which causes further acceleration of the ions through a skimmer orifice and into a lower pressure region including focusing lenses and analyzing apparatus. Alternatively, the skimmer can be maintained at ground. The skimmer orifice samples a portion of the gas expanding in the free jet, effectively serving to separate the higher-pressure viscous gas flow of the free jet that is found in the first vacuum pumping stage from subsequent vacuum pumping stages, which are maintained at lower background pressure relative to the first pumping stage. Once ions pass through the skimmer orifice, they may be required to pass through one or more additional pumping stages before entering the mass analyzer.

For practical and cost reasons, limited pumping speeds are employed in mass spectrometer instrumentation. Consequently, only a small amount of the ion laden atmospheric pressure gas is "leaked" into vacuum through the ion transfer tube. This has the unfortunate effect of limiting the sensitivity of the mass spectrometer, thereby requiring higher concentration of analyte in the sample solution for detection by the mass spectrometer. One way to augment the sensitivity of a mass spectrometer, such that lower concentrations of analyte can be detected, is to increase the amount of analyte containing vapor that is transferred from the ionization region into the vacuum region of the mass spectrometer. This is accomplished by increasing the throughput of the ion transfer tube, either by increasing the tube diameter or by reducing the tube length. Unfortunately, the resulting increased gas load causes the pressures in the vacuum chambers to increase as well. Since it is necessary to maintain the mass analyzer and detector region under high vacuum conditions, the increase in pressure must be counteracted by increasing the number of vacuum pumps employed and/or increasing the pumping capacity of the vacuum pumps. Of course, increasing the number and/or capacity of the vacuum pumps also increases the cost of the mass spectrometer, as well as the power requirements, shipping weight and cost, and bench space requirements.

There is a need for a system that increases the throughput of the ion transfer tube interface and that does not require additional vacuum pumps or increased pumping capacity of the vacuum pumps.

SUMMARY OF THE INVENTION

According to an aspect of the instant invention there is provided a multi-stage ion transfer tube assembly for supporting fluid communication between an ionization chamber of an ionization source and a low-pressure chamber of a mass spectrometer system, the multi-stage ion transfer tube assembly comprising: N ion transfer tubes disposed in a consecutive fashion one relative to another and extending between the ionization chamber and the lower pressure chamber of the mass spectrometer system, each of the N ion transfer tubes having an inlet end and an outlet end and an axial channel extending therebetween, wherein N>1; and, N−1 distinct intermediate pressure chambers, each distinct intermediate pressure chamber enclosing the outlet end of one of the N ion transfer tubes and the inlet end of an adjacent one of the N ion transfer tubes.

According to an aspect of the instant invention, provided is an ion source comprising: an ionization chamber for producing ions from a sample; a multi-stage ion transfer tube assembly comprising a first ion transfer tube having an inlet end and an outlet end, a second ion transfer tube having an inlet end and an outlet end, and a first intermediate pressure chamber enclosing the outlet end of the first ion transfer tube and the inlet end of the second ion transfer tube, the inlet end of the second ion transfer tube in fluid communication with the outlet end of the first ion transfer tube such that ions and gas exiting the outlet end of the first ion transfer tube are sampled into the inlet end of the second ion transfer tube; a plate having an orifice defined therethrough, the orifice spaced-apart from the outlet end of the second ion transfer tube; a low-pressure chamber enclosing the outlet end of the second ion transfer tube and the plate, the low-pressure chamber in fluid communication with the ionization chamber via the multi-stage ion transfer tube assembly; and, at least a vacuum pump in fluid communication with the low-pressure chamber for establishing a pressure gradient between the ionization chamber and the low-pressure chamber.

According to an aspect of the instant invention, provided is a mass spectrometer system comprising: a multi-stage vacuum chamber for establishing a progressively reduced pressure from a front stage to a back stage, via a middle stage, the multi-stage vacuum chamber comprising a plate that is disposed between the front stage and the middle stage, the plate having an orifice defined therethrough for sampling ions from the front stage into the middle stage of the multi-stage vacuum chamber; an ionization source for producing ions from a sample in the liquid phase and at a pressure substantially higher than that of the front stage of the vacuum chamber, the ionization source comprising a multi-stage ion transfer tube assembly for introducing the ions into the front stage of the multi-stage vacuum chamber via at least one intermediate pressure chamber that encloses facing ends of two separate ion transfer tubes of the multi-stage ion transfer tube assembly; and, a mass analyzer disposed within the back stage of the multi-stage vacuum chamber for analyzing ions that are received from the middle stage of the multi-stage vacuum chamber.

According to an aspect of the instant invention, provided is a method for introducing ions into a vacuum chamber of a mass spectrometer, comprising: producing ions in an ionization chamber of an ionization source; sampling the ions from the ionization chamber into an intermediate pressure chamber via a first ion transfer tube, the pressure within the intermediate pressure chamber being maintained at a value that exceeds a maximum pressure for being sampled into the vacuum chamber of the mass spectrometer; sampling some of the ions from the intermediate pressure chamber via at least a second ion transfer tube, the at least a second ion transfer tube having an outlet end that is in communication with a low-pressure chamber, the pressure within the low-pressure chamber being maintained at a value that is less than a maximum pressure for being sampled into the vacuum chamber of the mass spectrometer; and, sampling some of the ions from the low-pressure chamber into the vacuum chamber of the mass spectrometer.

BRIEF DESCRIPTION OF THE DRAWINGS

Exemplary embodiments of the invention will now be described in conjunction with the following drawings, in which similar reference numerals designate similar items.

DESCRIPTION OF EMBODIMENTS OF THE INSTANT INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and the scope of the invention. Thus, the present invention is not intended to be limited to the embodiments disclosed, but is to be accorded the widest scope consistent with the principles and features disclosed herein. Throughout the detailed description and in the claims that follow, it is to be understood that the term mass spectrometer is intended to include any kind of mass spectrometer or a hybrid combination of such mass spectrometers. Examples include but are not limited to: triple quadrupole, linear ion trap, cylindrical ion trap, 3D ion trap, Fourier transform ion cyclotron resonance, electrostatic ion traps, Fourier transform electrostatic ion trap, time of flight, and quadrupole time of flight. It is also to be understood that the term API probe is intended to include, by way of several non-limiting examples, an electrospray ionization (ESI) probe, a heated electrospray ionization (H-ESI) probe, an atmospheric pressure chemical ionization (APCI) probe, an atmospheric pressure photoionization (APPI) probe, and an atmospheric pressure laser ionization (APLI) probe. Furthermore, the term API probe is intended to include a "multi-mode" probe combining a plurality of the above-mentioned probe types. In general, the term API probe is intended to include any device that is capable of producing charged droplets or ions from a liquid or gas introduced into an API source.

Figure 1:
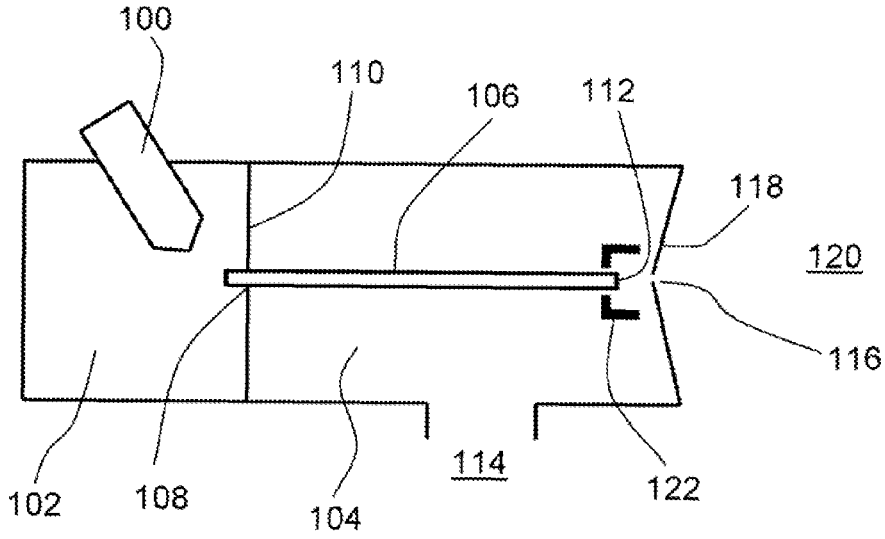
FIG. 1 is a simplified schematic diagram showing an atmospheric pressure ionization (API) source including an ionization chamber that is fluidly coupled to a low-pressure chamber via a one-stage ion transfer tube.

Referring to FIG. 1, shown is a simplified schematic diagram of an atmospheric pressure ionization (API) source including an ionization chamber that is fluidly coupled to a low-pressure chamber via a one-stage ion transfer tube. An API probe 100 produces ions within ionization chamber 102. The ions that are produced by the API probe 100 are sampled into the low-pressure chamber 104 via an ion transfer tube 106 that is mounted in a gas-tight fashion within an orifice 108 in the wall 110 that separates the ionization chamber 102 from the low-pressure chamber 104. A not illustrated vacuum pump, more specifically a roughing pump, is connected to vacuum port 114. By way of a few non-limiting examples, the not illustrated vacuum pump is one of a rotary vane pump, a roots blower and a scroll pump that is capable of maintaining the low-pressure chamber 104 at a pressure of about 0.1-50 torr. During operation, a pressure differential exists between the two opposite ends of ion transfer tube 106. The magnitude of this pressure differential is determined by the conductance of ion transfer tube 106, as well as the amount of pumping that is applied to the vacuum end 112, which is also referred to as the outlet end. The conductance of ion transfer tube 106 depends on its length, diameter and temperature. In particular, conductance decreases with decreasing diameter, increasing length, and increasing temperature. The ion transfer tube 106 optionally is fabricated from an electrically conductive material such as for instance a metal, fabricated from an electrically semiconductive material (such as silica or germanium), fabricated from resistive glass, or is fabricated from an electrically insulating material, such as for instance glass or quartz. In the latter case, a conductive coating may be formed on the ends of the ion transfer tube 106 and a voltage applied thereacross so as to establish an electric field to accelerate ions that are flowing through the ion transfer tube 106.

In the discussion that follows, it has been assumed that ion transfer tube 106 is a metallic ion transfer tube and that potentially, an electric field is established between the ion transfer tube and preceding or consecutive ion optical elements. Accordingly, ions that are entrained in the background gas of the ionization chamber 102 travel through the ion transfer tube 106 entrained in the gas flow, as explained in U.S. Pat. No. 4,977,320 and U.S. Pat. No. 5,245,186. Ions exit the outlet end 112 of ion transfer tube 106, enter into the low-pressure chamber 104, and are focused through orifice 116 of plate 118 (which can take the form of a skimmer) into a lower pressure chamber 120 of a not illustrated mass analyzer by the application of a suitable potential to a tube lens 122. Operation of tube lens 122 is well known, for instance as taught in U.S. Pat. No. 5,157,260, and the details are omitted from this description for the sake of improved clarity.

By way of a specific and non-limiting example, the length of ion transfer tube 106 is about 10 cm and the inside diameter is about 580 μm. When the ionization chamber 102 is maintained at 760 torr and the low-pressure chamber 104 is maintained at about 0.98 torr using two 30 $m^3$/hour pumps, then the inflow from the ionization chamber 102 into ion transfer tube 106 is about 1.29 liters per minute.

Figure 2:
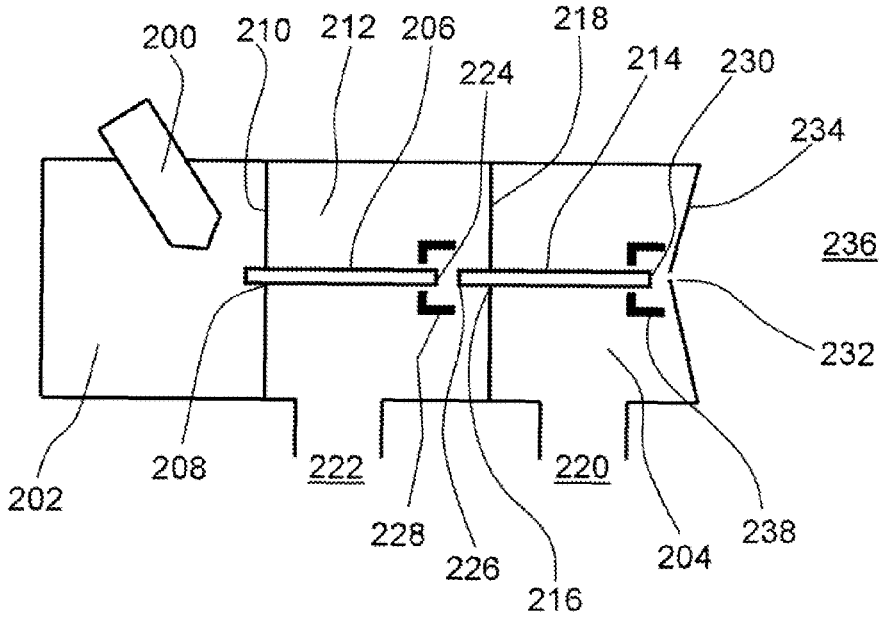
FIG. 2 is a simplified schematic diagram showing an API source including an ionization chamber that is fluidly coupled to a low-pressure chamber via a two-stage ion transfer tube assembly, according to an embodiment of the instant invention.

Referring now to FIG. 2, shown is a simplified schematic diagram of an API source including an ionization chamber that is fluidly coupled to a low-pressure chamber via a two-stage ion transfer tube assembly, according to an embodiment of the instant invention. An API probe 200 produces ions within ionization chamber 202. The ions that are produced by the API probe 200 are sampled into the low-pressure chamber 204 via a two-stage ion transfer tube assembly, which includes a first ion transfer tube 206 that is mounted in a gas-tight fashion within an orifice 208 in the wall 210 that separates the ionization chamber 202 from an intermediate pressure chamber 212. The two-stage ion transfer tube assembly further includes a second ion transfer tube 214 that is mounted in a gas-tight fashion within an orifice 216 in the wall 218 that separates the intermediate pressure chamber 212 from the low-pressure chamber 204. For the purpose of this discussion, it has been assumed that ion transfer tubes 206 and 214 are metallic ion transfer tubes and that potentially, an electric field is established between the ion transfer tube and preceding or consecutive ion optical elements. During operation, a first pressure differential exists between the two opposite ends of the first ion transfer tube 206 and a second pressure differential exists between the two opposite ends of the second ion transfer tube 214. According to this embodiment of the instant invention, a first not illustrated vacuum pump, such as for instance a first roughing pump, is connected to port 220 of the low-pressure chamber 204 and a second not illustrated vacuum pump, such as for instance a second roughing pump, is connected to port 222 of the intermediate pressure chamber 212. By way of a few non-limiting examples, the first not illustrated vacuum pump connected to port 220 is one of a rotary vane pump, a roots blower and a scroll pump, and the second not illustrated vacuum pump connected to port 222 is one of a rotary vane pump, a roots blower and a scroll pump. Optionally, the second not illustrated pump connected to port 222 of the intermediate pressure chamber is a venturi pump. Further optionally, the first and second not illustrated vacuum pumps are replaced by a single vacuum pump, such as for instance a two-stage pump, that is connected to the two ports 220 and 222.

Ions that are entrained in the background gas of the ionization chamber 202 travel inside the first ion transfer tube 206 due to the pressure differential that is established between its two opposite ends. Ions exit the outlet end 224 of the first ion transfer tube 206, enter into the intermediate pressure chamber 212, and are sampled into the second ion transfer tube 214 via an inlet end 226 thereof by the application of a suitable potential to a tube lens 228 that is adjacent the outlet end 224 of the first ion transfer tube 206. Similarly, ions travel through the second ion transfer tube 214, entrained in the gas flow. Ions exit the outlet end 230 of the second ion transfer tube 214, enter into the low-pressure chamber 204, and are focused through orifice 232 of skimmer 234 into a lower pressure chamber 236 of a not illustrated mass analyzer by the application of a suitable potential to a tube lens 238.

By way of a specific and non-limiting example, the length of the first ion transfer tube 206 is about 5 cm and its inside diameter is about 580 μm, and the length of the second ion transfer tube 214 is about 5 cm and its inside diameter is about 580 μm. When the ionization chamber 202 is maintained at about 760 torr, the intermediate pressure chamber 212 is maintained at about 3.8 torr using a first 30 $m^3$/hour pump, and the low-pressure chamber 204 is maintained at about 0.98 torr using a second 30 $m^3$/hour pump, then the inflow from the ionization chamber 202 into the first ion transfer tube 206 is about 2.56 liters per minute.

Figure 3:
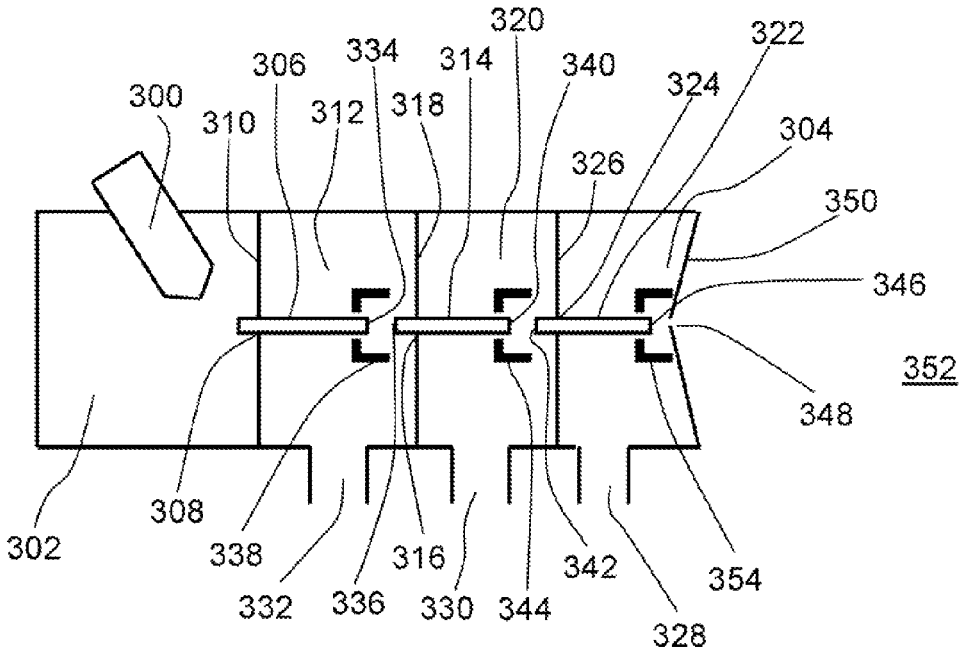
FIG. 3 is a simplified schematic diagram showing an API source including an ionization chamber that is fluidly coupled to a low-pressure chamber via a three-stage ion transfer tube assembly, according to an embodiment of the instant invention.

Referring now to FIG. 3, shown is a simplified schematic diagram of an API source including an ionization chamber that is fluidly coupled to a low-pressure chamber via a three-stage ion transfer tube assembly, according to an embodiment of the instant invention. An API probe 300 produces ions within ionization chamber 302. The ions that are produced by the API probe 300 are sampled into the low-pressure chamber 304 via a three-stage ion transfer tube assembly, which includes a first ion transfer tube 306 that is mounted in a gas-tight fashion within an orifice 308 in the wall 310 that separates the ionization chamber 302 from a first intermediate pressure chamber 312. The three-stage ion transfer tube assembly further includes a second ion transfer tube 314 that is mounted in a gas-tight fashion within an orifice 316 in the wall 318 that separates the first intermediate pressure chamber 312 from a second intermediate pressure chamber 320. The three-stage ion transfer tube assembly further includes a third ion transfer tube 322 that is mounted in a gas-tight fashion within an orifice 324 in the wall 326 that separates the second intermediate pressure chamber 320 from the low-pressure chamber 304. For the purpose of this discussion, it has been assumed that ion transfer tubes 306, 314 and 322 are metallic ion transfer tubes and that potentially, an electric field is established between the ion transfer tube and preceding or consecutive ion optical elements. During operation, a first pressure differential exists between the two opposite ends of the first ion transfer tube 306, a second pressure differential exists between the two opposite ends of the second ion transfer tube 314, and a third pressure differential exists between the two opposite ends of the third ion transfer tube 322. According to this embodiment of the instant invention, a first not illustrated vacuum pump, such as for instance a first roughing pump, is connected to port 328 of the low-pressure chamber 304, a second not illustrated vacuum pump, such as for instance a second roughing pump, is connected to port 330 of the second intermediate pressure chamber 320, and a third not illustrated vacuum pump, such as for instance a third roughing pump, is connected to port 332 of the first intermediate pressure chamber 312. By way of a few non-limiting examples, the first not illustrated vacuum pump connected to port 328 is one of a rotary vane pump, a roots blower and a scroll pump, the second not illustrated vacuum pump connected to port 330 is one of a rotary vane pump, a roots blower and a scroll pump, and the third not illustrated vacuum pump connected to port 332 is one of a rotary vane pump, a roots blower and a scroll pump. Optionally, the second not illustrated pump connected to port 330 of the second intermediate pressure chamber 320 is a venturi pump and/or the third not illustrated pump connected to port 332 is a venturi pump. Further optionally, the first and second not illustrated vacuum pumps are replaced by a single vacuum pump, such as for instance a two-stage pump, that is connected to the two ports 328 and 330.

Ions that are entrained in the background gas of the ionization chamber 302 travel inside the first ion transfer tube 306 due to the pressure differential that is established between its two opposite ends. Ions exit the outlet end 334 of the first ion transfer tube 306, enter into the first intermediate pressure chamber 312, and are sampled into the second ion transfer tube 314 via an inlet end 336 thereof by the application of a suitable potential to a tube lens 338 that is adjacent the outlet end 334 of the first ion transfer tube 306. Similarly, ions travel inside the second ion transfer tube 314 due to the pressure differential that is established between its two opposite ends. Ions exit the outlet end 340 of the second ion transfer tube 314, enter into the second intermediate pressure chamber 320, and are sampled into the third ion transfer tube 322 via an inlet end 342 thereof by the application of a suitable potential to a tube lens 344 that is adjacent the outlet end 340 of the second ion transfer tube 314. Ions travel inside through the third ion transfer tube 322, entrained in the gas flow. Ions exit the outlet end 346 of the third ion transfer tube 322, enter low-pressure chamber 304, and are focused through orifice 348 of plate 350 (which can take the form of a skimmer) into a lower pressure chamber 352 of a not illustrated mass analyzer by the application of a suitable potential to a tube lens 354.

In more general terms an embodiment of the instant invention includes a multi-stage ion transfer tube assembly, which assembly includes N consecutive ion transfer tubes (N>1). Each additional ion transfer tube communicates the ions through a partition between two separate chambers, such that there are N−1 additional vacuum stages compared to the single-stage ion transfer tube system shown in FIG. 1. It has been discovered that whilst maintaining the same pumping speed of the system and the same overall drop in pressure between the atmospheric pressure in the ionization chamber and the low-pressure chamber, the inflow amount of gas sampled from the atmospheric pressure ion source is higher with the multi-stage ion transfer tube assembly compared to the single-stage ion transfer tube shown in FIG. 1. Optionally, a multi-stage ion transfer tube assembly is utilized to obtain an equal inflow amount of gas sampled from the atmospheric pressure ion source and the same overall drop in pressure between the atmospheric pressure in source and the low-pressure chamber but with a lower total pumping speed of the system compared to the single-stage ion transfer tube system shown in FIG. 1.

Since the inflow amount of gas is increased in the multi-stage ion transfer tube assembly system, the absolute number of ions being sampled also is increased compared to the single-stage ion transfer tube system. Transferring the ions from one ion transfer tube to a consecutive ion transfer tube via an intermediate pressure chamber has the effect of increasing the ion to background gas ratio in the gas that is eventually passed through to the low-pressure region immediately in front of the skimmer. This pre-concentration effect is considered further in the following sections.

Figure 4A:
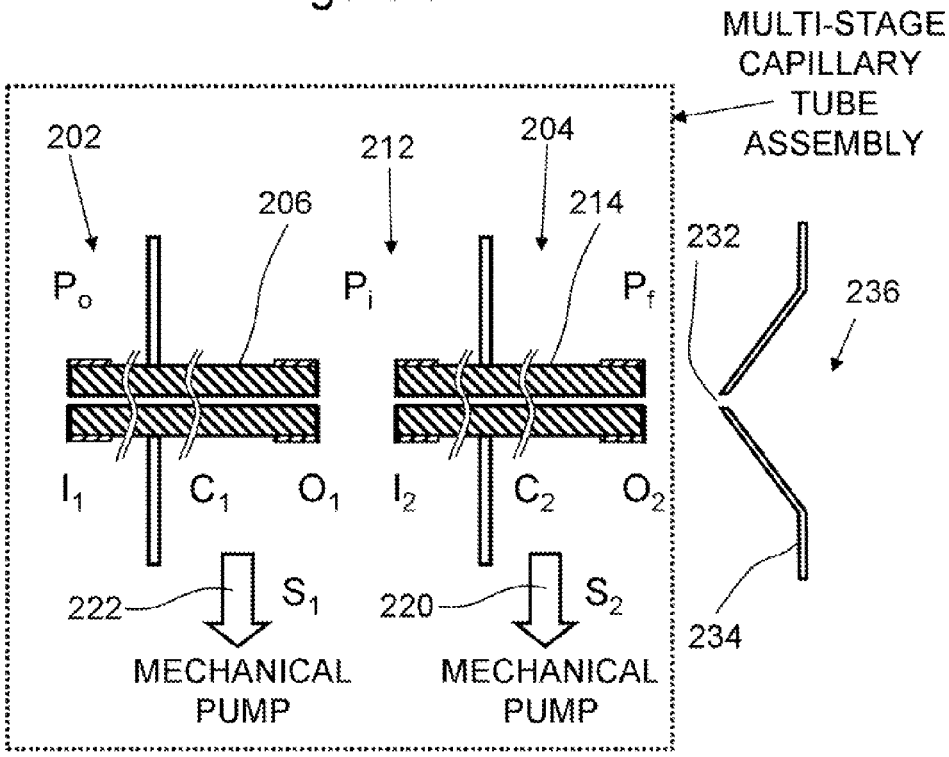
FIG. 4*a* is an enlarged view of a multi-stage ion transfer tube assembly according to an embodiment of the instant invention.
Figure 4B:
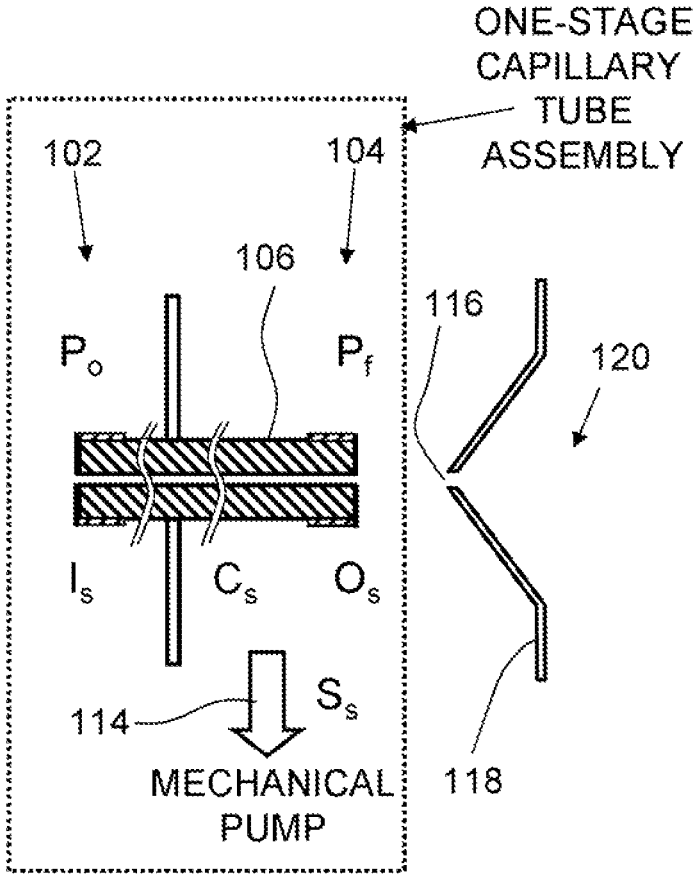
FIG. 4*b* is an enlarged view of a one-stage ion transfer tube.

Referring now to FIG. 4*a* and FIG. 4*b*, shown is an enlarged view of a multi-stage ion transfer tube assembly according to an embodiment of the instant invention and an enlarged view of a one-stage ion transfer tube, respectively. In FIG. 4*a* two separate ion transfer tubes 206, 214 are shown, wherein the symbols $I_1$ and $I_2$ denote the inflow (liters/second) of the first ion transfer tube 206 and of the second ion transfer tube 214, respectively. Using the same notation, the conductance ([torr*liters]/second) and outflow (liters/second) of the first ion transfer tube 206 and of the second ion transfer tube 214 are denoted $C_1$, $O_1$, $C_2$ and $O_2$, respectively. The pressures in the ionization chamber 202, in the intermediate pressure chamber 212 and in the low-pressure chamber 204 are denoted $P_o$, $P_i$ and $P_f$, respectively. The pumping capacity (liters/second) of the pump connected to port 222 and of the pump connected to port 220 is denoted $S_1$ and $S_2$, respectively. In FIG. 4*b* only one ion transfer tube is shown, wherein the symbols $I_s$, $C_s$ and $O_s$ denote the inflow, conductance and outflow of the ion transfer tube 106, respectively. The pressures in the ionization chamber 102 and in the low-pressure chamber 104 are denoted $P_o$ and $P_f$, respectively. The pumping capacity of the pump that is connected to port 114 is denoted $S_s$. It is assumed for the purpose of this discussion that the values of $P_o$ and $P_f$ are the same in FIGS. 4*a* and 4*b*, such that the overall pressure drop between the ionization chamber and the low-pressure chamber is the same in both cases. It is further assumed that the overall pumping capacity is the same, e.g. $S_s=S_1+S_2$.

The following relationships may be written for the case of the two-stage ion transfer tube assembly that is illustrated in FIG. 4*a:*

$$O_2 \cong S_2 \quad (1)$$

$$C_2=O_2*P_f \quad (2)$$

$$I_2=C_2/P_i \quad (3)$$

$$O_1=S_1+I_2 \quad (4)$$

$$C_1=O_1*P_i \quad (5)$$

$$I_1=C_1/P_o \quad (6)$$

Similarly, the following relationships may be written for the case of the one-stage ion transfer tube assembly that is illustrated in FIG. 4*b:*

$$O_s \cong S_s \quad (7)$$

$$C_s=O_s*P_f \quad (8)$$

$$I_s=C_s/P_o \quad (9)$$

In equations (1) and (7) it has been assumed that $O_s \cong S_s$ and that $O_2 \cong S_2$, which does not take into account a small leak rate through the skimmer orifice into the lower pressure chamber that houses the mass analyzer and detector. However, the small leak rate is negligible compared to the pumping capacity in both cases, and does not affect the current discussion in any meaningful way.

Equations (7), (8) and (9) may be rearranged in a straight forward manner to obtain:

$$I_s=S_s*P_f/P_o \quad (10)$$

With only slightly more effort, equations (1) through (6) may be rearranged to obtain:

$$I_1=S_1*P_i/P_o+S_2*P_f/P_o \quad (11)$$

As stated above, it is assumed that $S_s=S_1+S_2$. It now will be further assumed that $S_1=S_2=½\ S_s$. Accordingly:

$$I_1=S_s*P_i/2P_o+S_s*P_f/2P_o \quad (12)$$

But since $P_i>P_f$, therefore it may be determined from an inspection of equations (10) and (12) that $I_1>I_s$. In other words, the amount of ions per unit time that is sampled from the API source is always greater in the situation that is illustrated in FIG. 2 compared to the situation that is illustrated in FIG. 1, even though the pumping capacity in both cases is the same. The increase in inflow using the multi-stage ion transfer tube assembly shown in FIG. 2, e.g. the ratio $I_1/I_s$, potentially can be as high as a factor of 758×, with more typical values being about a factor of 2× to about a factor of 300×, depending on the chosen division of total pumping speed over ports 222 and 220, in combination with the selected pressure $P_i$ in the intermediate pressure chamber. Accordingly, even for the more general case in which the chosen division of total pumping speed over ports 222 and 230 satisfies the condition $S_s=S_1+S_2$ but not necessarily the condition $S_1=S_2=½\ S_s$, it can be mathematically shown that $I_1>I_s$. In particular, division of equation (11) by equation (10) yields:

$$I_1/I_s=[S_1*P_i/S_s*P_f]+[S_2/S_s] \quad (13)$$

By substituting the relationship $S_2=S_s-S_1$ into equation (13), the following is obtained:

$$I_1/I_s=1+(S_1/S_s)[P_i/P_f)-1] \quad (14)$$

Since $P_i/P_f>1$, then $I_1/I_s>1$, or more succinctly $I_1>I_s$.

By increasing the inflow $I_1$ of the first ion transfer tube with respect to the single stage ion transfer tube inflow $I_s$, an increased volume rate of sample is let in from the API source into the mass spectrometer instrument. As discussed supra the charged particles are pre-concentrated from the other inflowing gas in the intermediate pressure chamber, and still the pressure in the analyzer region of the mass spectrometer instrument is limited to the usual value by restricting the throughput of the second ion transfer tube. The pre-concentration effect, which increases the analyte ion to background gas ratio and also the analyte ion to solvent cluster ion ratio, may occur for several reasons, including (but not limited to): (1) flyout/scattering of lighter particles such as background gas, e.g. nitrogen and oxygen, so sampling of the core of the expansion from the previous ion transfer tube by the subsequent ion transfer tube increases concentration of analyte ions on the center line; (2) electric field applied to focus analyte ions but not background neutrals and also to focus ions dependent on mass; and, (3) collisions, the frequency of which is dependent on pressure $P_i$ in the intermediate pressure chamber, that break up solvent clusters.

Of course, a number of modifications to the multi-ion transfer tube assembly shown generally at FIGS. 2 and 3 may be envisaged. For instance, the length and/or diameter and/or spacing of a first ion transfer tube relative to a second ion transfer tube may be different, thereby affecting the throughput of each ion transfer tube and causing the pressure differential between the two ends of the first ion transfer tube to be different than the pressure differential between the two ends of the second ion transfer tube. These differences can be exploited by optimizing the sensitivity of a mass analyzer within the lower pressure chamber with respect to the pressure $P_i$ in the intermediate pressure chamber in the range between the fixed atmospheric pressure of the API source and the fixed pressure $P_f$ in front of the skimmer orifice leading to the mass analyzer. Optionally, sensitivity optimization in the mass analyzer is achieved by varying the relative pumping speeds applied to ports 220 and 222, which also influences $P_i$ in the intermediate pressure chamber. Further optionally, one or more of the ion transfer tubes in a multi-ion transfer tube assembly are heated, and optionally different tubes are heated to different temperatures to as to optimize the desolvation process.

Further optionally, a focusing or deflecting electric field may be applied between the outlet end of a first ion transfer tube and the inlet end of a second ion transfer tube that is adjacent the first ion transfer tube. In FIGS. 2 and 3, tube lenses are provided for this purpose. The tube lenses affect the trajectories of charged particles (e.g. ions) but not the trajectories of the neutral background gas. In this way, the ions are preferentially directed toward the inlet end of the second ion transfer tube, whereas the neutral background gas tends to spread away from the longitudinal axis due to the free jet expansion that occurs when the gas encounters the lower pressure conditions of the intermediate pressure chamber. The neutral background gas is pumped continuously out through the vacuum port of the intermediate pressure chamber, such that the pressure is approximately constant. Yet further optionally, the first ion transfer tube can be a plurality (M) of ion transfer tubes such that ions exit the plurality of first ion transfer tubes and enter the inlet end of a second ion transfer tube (1), an M:1 ion transfer tube arrangement.

Figure 5:
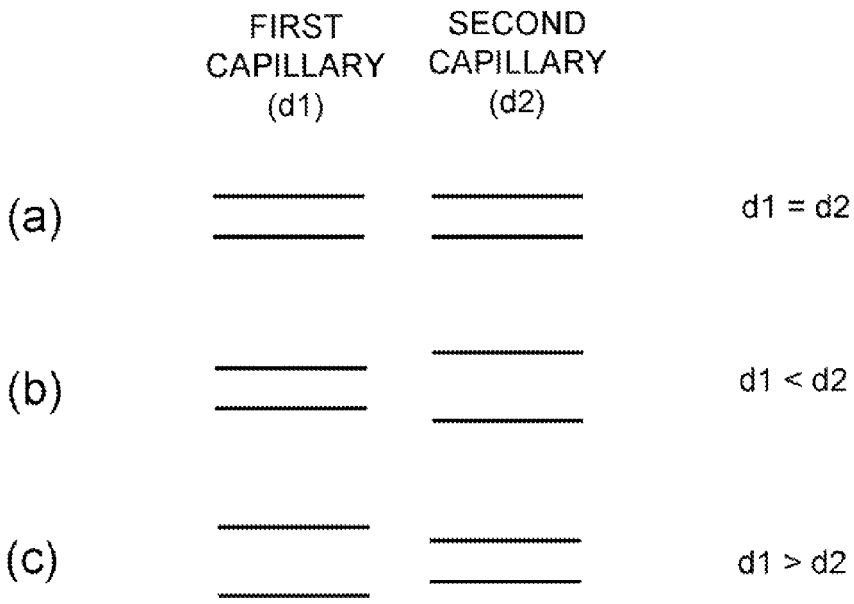
FIG. 5*a* is a simplified schematic diagram showing two consecutive ion transfer tubes of equal diameter.
FIG. 5*b* is a simplified schematic diagram showing two consecutive ion transfer tubes, wherein the first ion transfer tube has a smaller diameter than the second ion transfer tube.
FIG. 5*c* is a simplified schematic diagram showing two consecutive ion transfer tubes, wherein the first ion transfer tube has a larger diameter than the second ion transfer tube.

Referring now to FIG. 5*a*, shown is a simplified schematic diagram of two consecutive ion transfer tubes of equal diameter (d1=d2).

Referring now to FIG. 5*b*, shown is a simplified schematic diagram of two consecutive ion transfer tubes, wherein the first ion transfer tube has a smaller diameter than the second ion transfer tube (d1<d2).

Referring now to FIG. 5*c*, shown is a simplified schematic diagram of two consecutive ion transfer tubes, wherein the first ion transfer tube has a larger diameter than the second ion transfer tube (d1>d2).

Figure 6:
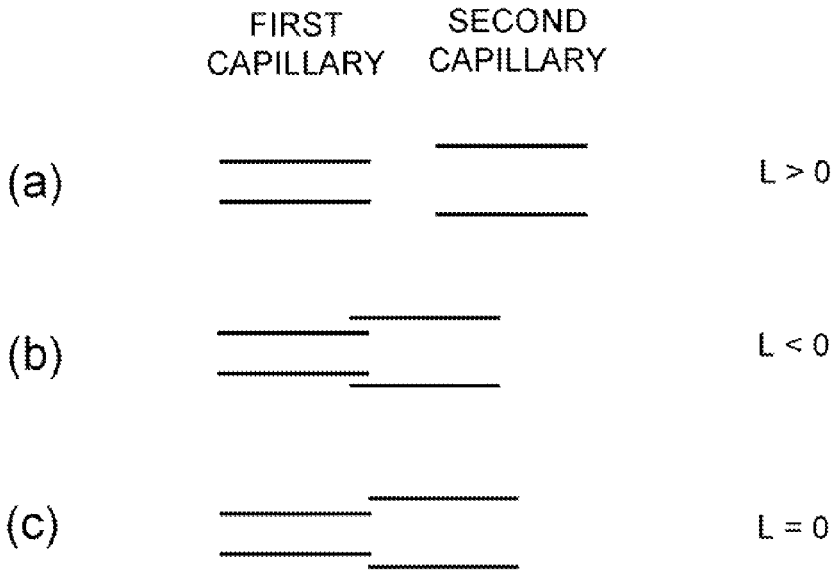
FIG. 6*a* is a simplified schematic diagram showing two consecutive ion transfer tubes in a spaced-apart end-to-end arrangement, with an inter-tube spacing (L) greater than zero.
FIG. 6*b* is a simplified schematic diagram showing two consecutive ion transfer tubes in an overlapping end-to-end arrangement, with an inter-tube spacing (L) less than zero.
FIG. 6*c* is a simplified schematic diagram showing two consecutive ion transfer tubes in a flush-mounted end-to-end arrangement, with an inter-tube spacing (L) equal to zero.

Referring now to FIG. 6*a*, shown is a simplified schematic diagram showing two consecutive ion transfer tubes in a spaced-apart end-to-end arrangement, with an inter-tube spacing (L) greater than zero.

Referring now to FIG. 6*b*, shown is a simplified schematic diagram showing two consecutive ion transfer tubes in an overlapping end-to-end arrangement, with an inter-tube spacing (L) less than zero.

Referring now to FIG. 6*c*, shown is a simplified schematic diagram showing two consecutive ion transfer tubes in a flush-mounted end-to-end arrangement, with an inter-tube spacing (L) equal to zero.

Figure 7:
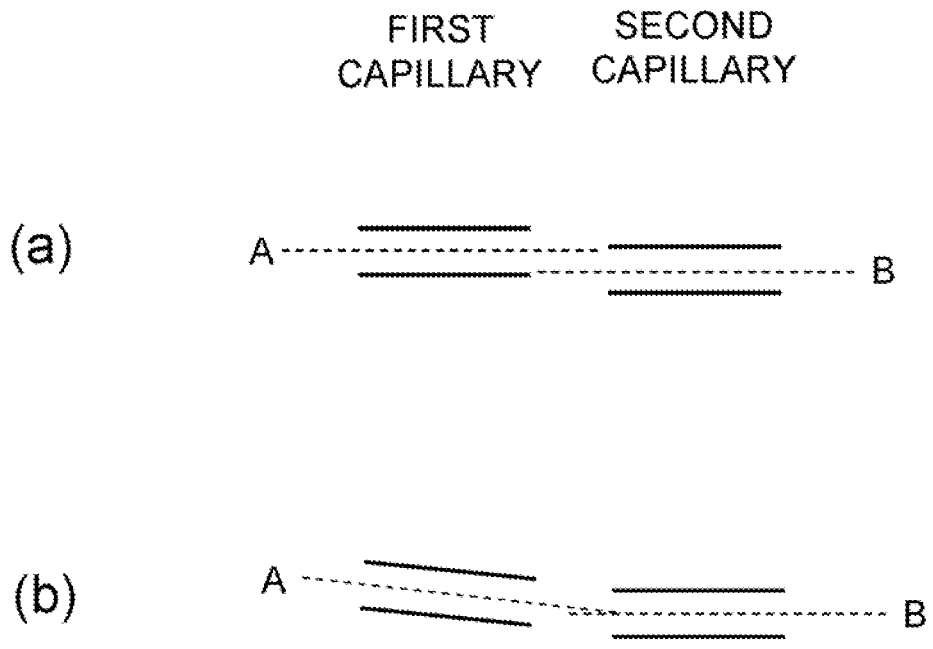
FIG. 7*a* is a simplified schematic diagram showing two consecutive ion transfer tubes, the axis of one ion transfer tube being offset with respect to the axis of the next ion transfer tube.
FIG. 7*b* is a simplified schematic diagram showing two consecutive ion transfer tubes, the angle between the longitudinal axes of the two consecutive ion transfer tubes being greater than 0° but less than 180°.

Referring now to FIG. 7*a*, shown is a simplified schematic diagram of two consecutive ion transfer tubes, the axis of one ion transfer tube being offset with respect to the axis of the next ion transfer tube.

Referring now to FIG. 7*b*, shown is a simplified schematic diagram of two consecutive ion transfer tubes, the angle between the longitudinal axes of the two consecutive ion transfer tubes being greater than 0° but less than 180°.

Optionally, a focusing or deflecting electric field is applied between the facing ends of the two consecutive ion transfer tubes in FIG. 5*a*, 5*b*, 5*c*, 6*a*, 6*b*, 6*c*, 7*a* or 7*b*, for guiding ions that exit from the first ion transfer tube into the channel of the second ion transfer tube.

It should be noted, that in referring to FIG. 5*a*, 5*b*, 5*c*, 6*a*, 6*b*, 6*c*, 7*a* or 7*b*, there is not a gas-tight union between the facing ends of the consecutive ion transfer tubes.

A benefit of using ion transfer tubes of different diameters is that the tube lens can be removed so as to permit the first ion transfer tube to slide inside the second ion transfer tube, or vice versa. This is possible when the inside diameter of one ion transfer tube is bigger than the outside diameter of the other ion transfer tube. This concept could be used in order to discriminate heavier/larger particulates with respect to lighter/smaller particulates since during the expansion occurring between the ion transfer tubes lighter particulates are scattered away from the center axis with a wider angle compared to the heavier ones. Since the lighter particulates include small solvent clusters or laboratory air molecules such as nitrogen and oxygen, it is beneficial to decrease their concentration in the ions sampled from the ion source.

Optionally, the ion transfer tubes include those having a length in the range of about 0.13 mm (0.005") to about 2.0 mm (0.080"), and therefore the entrance orifice coincides with the exit orifice such that the ion transfer tube in effect becomes an orifice. Further optionally, the ion transfer tubes and/or orifices can have a cross section that is other than circular. Further optionally, the ion transfer tubes are of different lengths one compared to another. In general and by way of non-limiting example, each ion transfer tube has a length of between about 2.5 cm (1.0") and about 25 cm (10.0"), with a length of between about 2.5 cm (1.0") and about 7.5 cm (3.0") being a typical value for many applications. Furthermore, in general and by way of non-limiting example, each ion transfer tube has a diameter of between about 150 (0.006") and about 8 mm (0.31").

Figure 8:
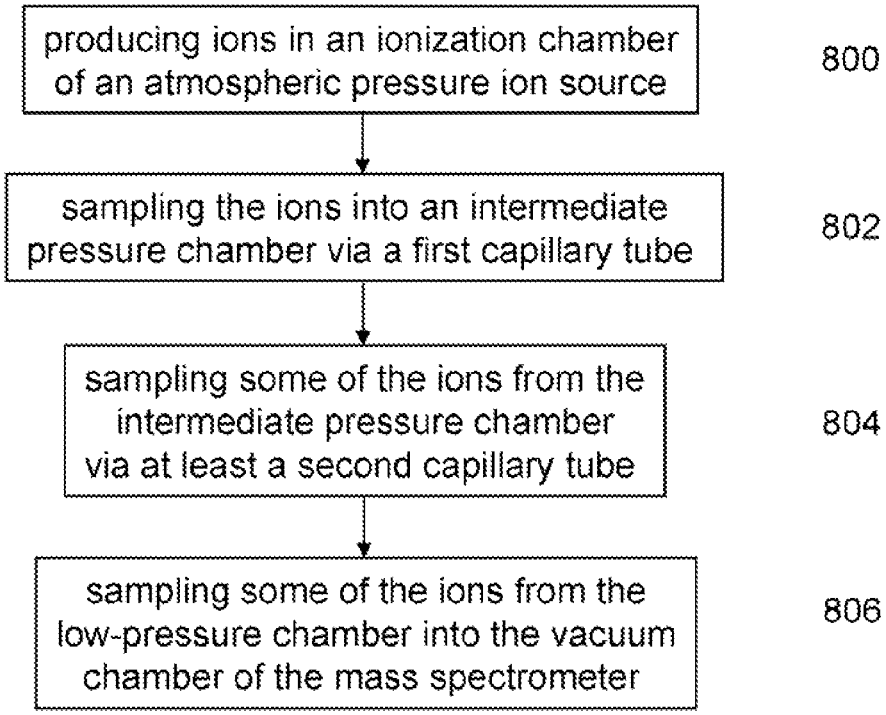
FIG. 8 is a simplified flow diagram of a method according to an embodiment of the instant invention; and, FIG. 9 is a simplified schematic diagram showing a mass spectrometer system according to an embodiment of the instant invention.

Referring now to FIG. 8, shown is a simplified flow diagram of a method according to an embodiment of the instant invention, for introducing ions into a vacuum chamber of a mass spectrometer. At step 800, ions are produced in an ionization chamber of an atmospheric pressure ionization (API) source. For instance, the API source optionally is one of an electrospray ionization (ESI) source, a heated electrospray ionization (H-ESI) source, an atmospheric pressure chemical ionization (APCI) source, an atmospheric pressure photoionization (APPI) source, and an atmospheric pressure laser ionization (APLI) source. Further optionally, the API source is a "multi-mode" source combining a plurality of the above-mentioned sources. In general, the API source is any device that is capable of producing charged droplets or ions from a liquid or gas introduced into the API source. At step 802 the ions produced in the ionization chamber of the API source are sampled into an intermediate pressure chamber via a first ion transfer tube, the pressure within the intermediate pressure chamber being maintained at a value that exceeds a maximum pressure for being sampled into the vacuum chamber of the mass spectrometer. At step 804 some of the ions are sampled from the intermediate pressure chamber via at least a second ion transfer tube, the at least a second ion transfer tube having an outlet end that is in communication with a low-pressure chamber, the pressure within the low-pressure chamber being maintained at a value that is less than a maximum pressure for being sampled into the vacuum chamber of the mass spectrometer. At step 806 some of the ions from the low-pressure chamber are sampled into the vacuum chamber of the mass spectrometer.

Figure 9:
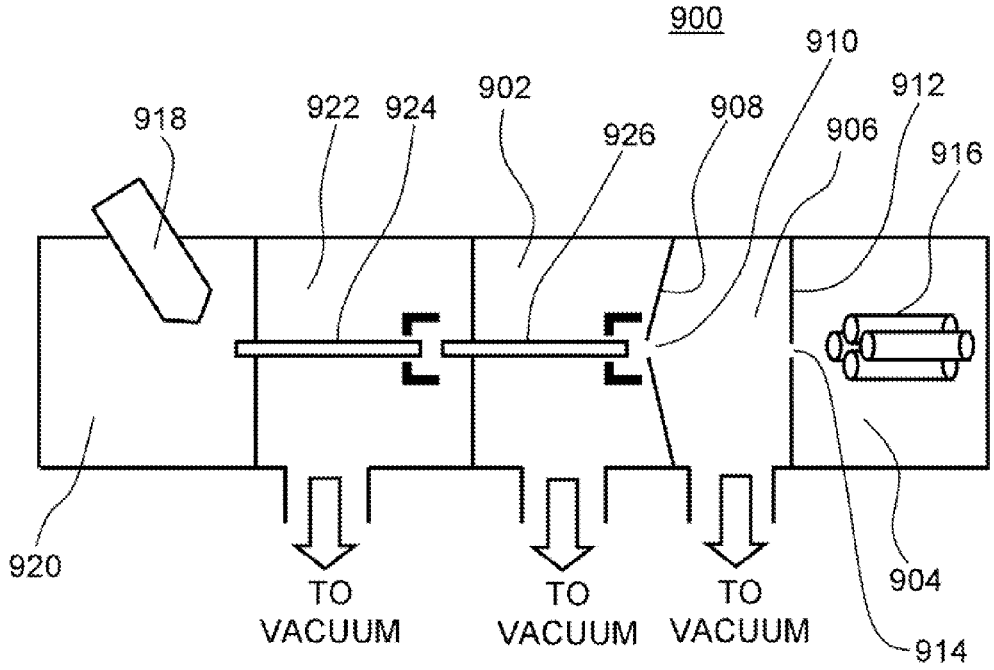

Referring now to FIG. 9, shown is a simplified schematic diagram of a mass spectrometer system according to an embodiment of the instant invention. The mass spectrometer system 900 includes a multi-stage vacuum chamber for establishing a progressively reduced pressure from a front stage 902 to a back stage 904, via a middle stage 906. The multi-stage vacuum chamber includes a plate 908 (which can take the form of a skimmer) that is disposed between the front stage 902 and the middle stage 906, the skimmer having an orifice 910 defined therethrough for sampling ions from the front stage 902 into the middle stage 906 of the multi-stage vacuum chamber. A partition 912 having an orifice 914 defined therethrough separates the middle stage 906 and the back stage 904. During use, the background gas pressure that is maintained within the back stage 904 is selected in dependence upon the operating requirements of mass analyzer 916, which in this specific example is shown as a quadrupole mass analyzer. An ionization source is provided for producing ions from a sample in the liquid phase and at a pressure substantially higher than that of the front stage 902 of the multi-stage vacuum chamber. The ionization source includes a probe 918 that is disposed within ionization chamber 920. A multi-stage ion transfer tube assembly is provided for introducing the ions from the ionization chamber 920 into the front stage 902 of the multi-stage vacuum chamber. In particular, the multi-stage ion transfer tube assembly includes at least one intermediate pressure chamber 922 that encloses facing ends of two separate ion transfer tubes 924 and 926 of the multi-stage ion transfer tube assembly. Ions produced in the ionization chamber 920 are transferred into the front stage 902 via the multi-stage ion transfer tube assembly, pass through the orifice 910 into the middle stage 906, and then pass through orifice 914 into the back stage 904 where they are analyzed using mass analyzer 916.

Numerous other embodiments may be envisaged without departing from the spirit and scope of the invention.

What is claimed is:

1. A multi-stage capillary tube assembly for supporting fluid communication between an ionization chamber of an ionization source and a low-pressure chamber of a mass spectrometer system, the multi-stage capillary tube assembly comprising:

N capillary tubes disposed in a consecutive fashion one relative to another and extending between the ionization chamber and the low-pressure chamber of the mass spectrometer system, each of the N capillary tubes having an inlet end and an outlet end and an axial channel extending therebetween, wherein N>1; and, N−1 distinct intermediate pressure chambers, each distinct intermediate pressure chamber enclosing the outlet end of one of the N capillary tubes and the inlet end of an adjacent one of the N capillary tubes, wherein the diameter of the axial channel of one of the N capillary tubes is different than the diameter of the axial channel of an adjacent one of the N capillary tubes and wherein the inlet end of the one of the N capillary tubes is supported in an overlapping relationship within the outlet end of the adjacent one of the N capillary tubes.

2. A multi-stage capillary tube assembly according to claim 1, further comprising at least a vacuum pump in fluid communication with the low-pressure chamber for establishing progressively lower pressure values along a flow path that is defined between the ionization chamber and the low-pressure chamber via the N−1 intermediate pressure chambers.

3. A multi-stage capillary tube assembly according to claim 1, wherein the ionization chamber is an ionization chamber of an atmospheric pressure ionization source.

4. A multi-stage capillary tube assembly according to claim 1, wherein a focusing or deflecting electric field is applied between the outlet end of one of the N capillary tube and the inlet end of an adjacent one of the N capillary tubes, for focusing or deflecting ions exiting from the outlet end of the one of the N capillary tubes into the inlet end of the adjacent one of the N capillary tubes.

5. A multi-stage capillary tube assembly according to claim 1, wherein N=2.

6. A multi-stage capillary tube assembly according to claim 1, comprising an electrode between the outlet end of one of the N capillary tubes and the inlet end of an adjacent one of the N capillary tubes, the electrode for establishing an electric field for focusing or deflecting ions exiting from the outlet end of the one of the N capillary tubes into the inlet end of the adjacent one of the N capillary tubes.

7. An ion source comprising:

an ionization chamber for producing ions from a sample;

a multi-stage capillary tube assembly comprising a first capillary tube having an inlet end and an outlet end and a first inside diameter, a second capillary tube having an inlet end and an outlet end and a second inside diameter different than the first inside diameter, and a first intermediate pressure chamber enclosing the outlet end of the first capillary tube and the inlet end of the second capillary tube, the inlet end of the second capillary tube in fluid communication with the outlet end of the first capillary tube such that ions and gas exiting the outlet end of the first capillary tube are sampled into the inlet end of the second capillary tube;

a plate having an orifice defined therethrough, the orifice spaced-apart from the outlet end of the second capillary tube;

a low-pressure chamber enclosing the outlet end of the second capillary tube and the plate, the low-pressure chamber in fluid communication with the ionization chamber via the multi-stage capillary tube assembly; and at least a vacuum pump in fluid communication with the low-pressure chamber for establishing a pressure gradient between the ionization chamber and the low pressure chamber, wherein the first capillary tube is supported relative to the second capillary tube such that the inlet end of the second capillary tube is disposed in an overlapping relationship within the outlet end of the first capillary tube.

8. An ion source according to claim 7, wherein the at least a vacuum pump comprises a first vacuum pump coupled to the intermediate pressure chamber via a vacuum port of the intermediate pressure chamber for providing a pressure therein that is lower than the pressure within the ionization chamber, and a second vacuum pump coupled to the low-pressure chamber via a vacuum port of the low-pressure chamber for providing a pressure therein that is lower than the pressure within the intermediate pressure chamber.

9. An ion source according to claim 7, further comprising an electrode between the outlet end of the first capillary tube and the inlet end of the second capillary tube for establishing an electric field for focusing or deflecting ions exiting from the outlet end of the first capillary tube into the inlet end of the second capillary tube.

10. An ion source according to claim 7, comprising a first partition separating the ionization chamber from the first intermediate pressure chamber and comprising a second partition separating the first intermediate pressure chamber from the low-pressure chamber, wherein at least one of the first capillary tube and the second capillary tube comprises an orifice defined through the first partition and the second partition, respectively.

11. A multi-stage ion transfer tube assembly for supporting fluid communication between an ionization chamber of an atmospheric pressure ionization source that is either an electrospray ionization (ESI) source or an atmospheric pressure chemical ionization (APCI) source and an evacuated chamber of a mass analyzer, the multi-stage ion transfer tube assembly comprising:

N ion transfer tubes disposed in a consecutive fashion and spaced apart one relative to another and extending between the ionization chamber and the evacuated chamber of the mass analyzer system, each of the N ion transfer tubes having an inlet end and an outlet end and an axial channel extending therebetween, wherein N>1; and N distinct regions of intermediate or low pressure, each such region within a respective intermediate or low pressure chamber, wherein the outlet end of the one of the N ion transfer tubes is supported in an overlapping relationship within the inlet end of the adjacent one of the N ion transfer tubes.

* * * * *